United States Patent [19]

Feist

[11] 4,052,012

[45] Oct. 4, 1977

[54] PORTABLE FLOUR MILL

[75] Inventor: Donovan R. Feist, Minot, N. Dak.

[73] Assignee: Mill & Mix Company, Inc., Brigham City, Utah

[21] Appl. No.: 450,794

[22] Filed: Mar. 13, 1974

[51] Int. Cl.[2] ..... B02C 7/14

[52] U.S. Cl. ..... 241/100; 241/248; 241/259.1; 241/261.2

[58] Field of Search ..... 241/37, 248, 259.1, 241/259.3, 261.2, 296, 100

[56] References Cited

U.S. PATENT DOCUMENTS

| | | | |
|---|---|---|---|
| 1,705,996 | 3/1929 | Pope | 241/259.1 X |
| 3,038,673 | 6/1962 | Fisher | 241/259.1 X |
| 3,076,487 | 2/1963 | Illsley | 241/248 X |
| 3,102,694 | 9/1963 | Frenkel | 241/259.1 X |
| 3,302,893 | 2/1967 | Feder et al. | 241/37 |
| 3,638,871 | 2/1972 | Barger | 241/296 X |
| 3,684,200 | 8/1972 | Rein Hall | 241/259.1 |
| 3,688,996 | 9/1972 | Kuest | 241/259.1 X |

*Primary Examiner*—Roy Lake
*Assistant Examiner*—Howard N. Goldberg
*Attorney, Agent, or Firm*—B. Deon Criddle

[57] ABSTRACT

A home flour mill for family use having a stationary stone supported by one wall of an outer housing, an electric motor driving a revolving stone cooperable with the stationary stone to accomplish the grinding, a threaded rod and double lock nut means for moving the electric motor and its associated stone toward and away from the fixed stone. Feeding and discharging hopper means and passageway means for leading grain to and from the area between the stones, and bag retaining means in the outer housing to hold a bag to receive the ground flour. A removable cover and internal support means for the motor, hopper, and associated structure; and further rod means for retaining the stationary stone in position and parallel to the rotating stone.

13 Claims, 5 Drawing Figures

PORTABLE FLOUR MILL

FIELD OF THE INVENTION AND SUMMARY OF THE PRIOR ART

Portable grain grinding mills have been known for over a century, an exemplary patent of this vintage being the reissue patent to Straub (U.S. Pat. No. Re. 8,712, issued May 13, 1879). The Snyder (U.S. Pat. No. 1,571,812, issued Feb. 2, 1926) and Dimm et al (U.S. Pat. No. 2,216,611, issued Oct. 1, 1940) patents being similar in that the threaded adjusting means for the rotor stone is coaxial with the shaft of the motor. The Barber patent (U.S. Pat. No. 3,638,871, issued Feb. 1, 1972) has means for feeding grain, means for mounting a container for receiving the ground grain, and a relatively movable stator stone. A more recent patent to Reinhall (U.S. Pat. No. 3,790,092, issued Feb. 5, 1974) similarly discloses paired disks to grind vegetable produce and means to insure a coolant supply through "grooves" in the stones to avoid overheating the produce during grinding.

SUMMARY OF THE INVENTION

Among the objects and advantages of my invention are the following:

1. To provide a low initial cost and economy in operation in mills for home use.
2. To provide simple means for insuring parallelism of the grinding stones.
3. To provide easily operated means which will not require modification of the motor driving means, to move the motor and its associated rotating stone toward and from the stationary stone to provide for fine or coarse grinding, as desired.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
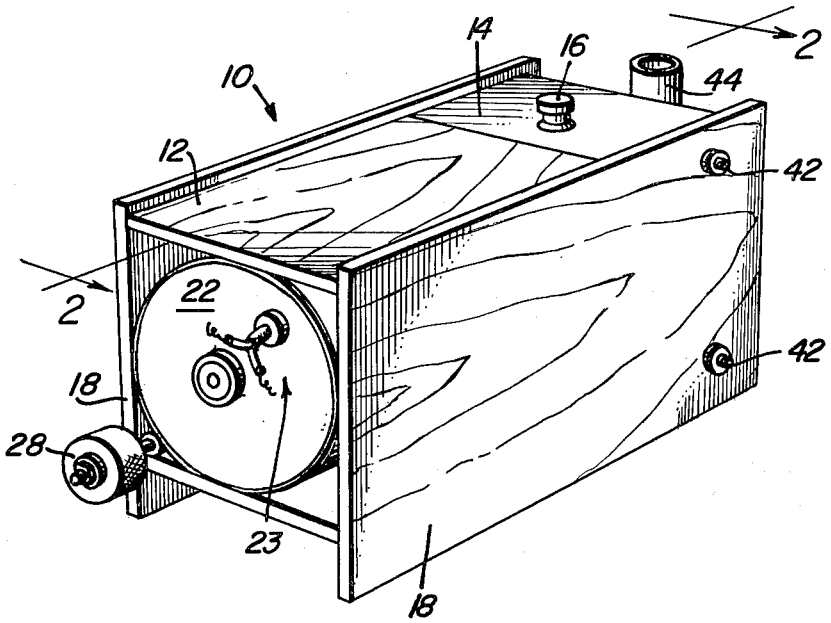
FIG. 1 is a perspective view of the over-all mill ready for use in the home.
Figure 4:
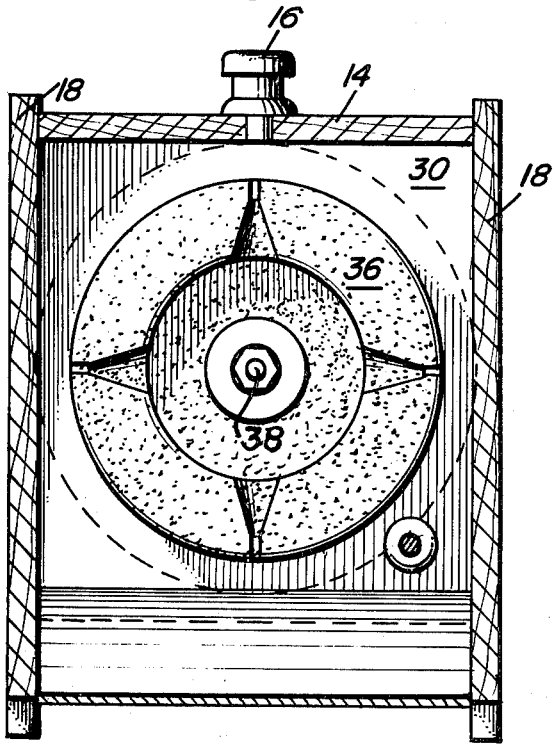
FIG. 4 is an internal view, looking at the rotating grinding stone, partly in cross-section, taken approximately along the line 4—4 of FIG. 3.

The over-all mill is designated by reference numeral 10. The main top wall 12, and removable top wall 14, having a handle 16, are mounted between the two vertical side walls 18, to form the outer housing for the mill. A partial bottom wall 20 is shown under the motor 22 (FIG. 2), and appropriate wiring 23 for the motor appears in FIGS. 1–3. As illustrated, the periphery of the motor 22 abuts the four walls 12, 18, and 20, lending rigidity to the entire unit.

Sleeve-like portions 24 are formed as extensions on the periphery of the outer wall of the motor 22, for loosely receiving the threaded rod 26. Double lock nuts 25 are provided on the threaded rod 26 adjacent the extremities of the sleeve-like portions 24 to fix the position of the rod 26 in relation to the motor 22. The rod 26 extends beyond one end of the housing and has a turning knob 28 attached thereto. The opposite end of rod 26 passes through wall 30, and is threadably received in claw-nut 31 the claws of which are adapted to penetrate into the wall 30 and to thereby fix the position of nut 31.

The drive shaft 38 of the motor 22 passes through a bushing 39 attached to the wall 30 and an aperture 37 in said wall 30. Rotating stone 36 is affixed to the end of drive shaft 38 by a fastening means 41. The non-rotating stone 34 is permanently affixed to end wall 32 via the securing plate member 43.

A central opening 45 in the stone 34 mates with the bottom of the fillling spout 44 to lead the incoming grain to the area between the stones. The spout 44 having a close fit with the end wall 32 as it passes therethrough, and the end wall thus supporting the spout 44 and its associated structures (a kitchen funnel or a plastic bottle having its bottom cut-off 46).

In adjusting the non-rotating stone 34 toward the rotating stone 36, for stone surface parallelism, the retaining and tightening rods 40 which pass through both of the vertical side walls 18 and are spaced from end wall 32, are loosened via the claw-nuts 42 (similar to claw-nut 31), and the entire wall 32, with stone 34, is moved incrementally to the right (as viewed in FIGS. 2 and 3) until the facing surfaces of the stones 34 and 36 barely touch each other, thus insuring the desired parallelism. Once the stones are in this position, the rods 40 and claw-nuts 42 are retightened to hold the stones in this parallel relationship.

Figure 5:
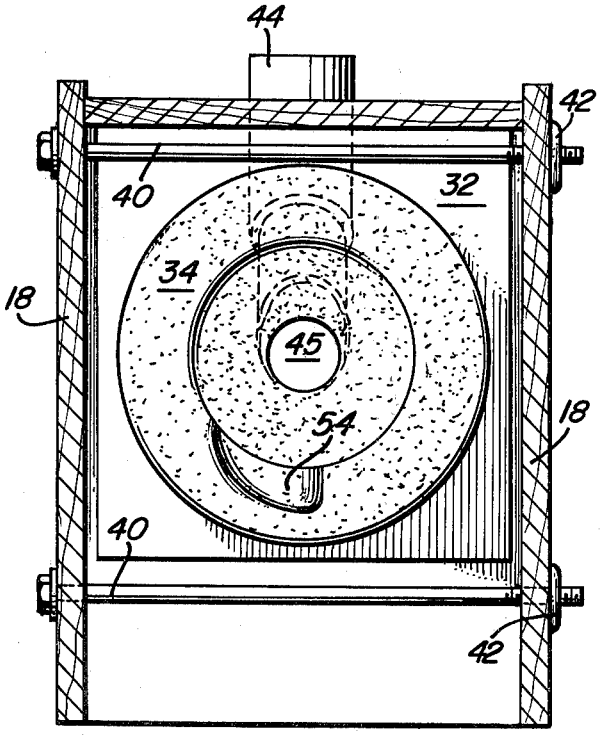
FIG. 5 is another internal view, looking at the stationary grinding stone attached to the movable end wall, taken approximately along the line 5—5 of FIG. 3.
Figure 2:
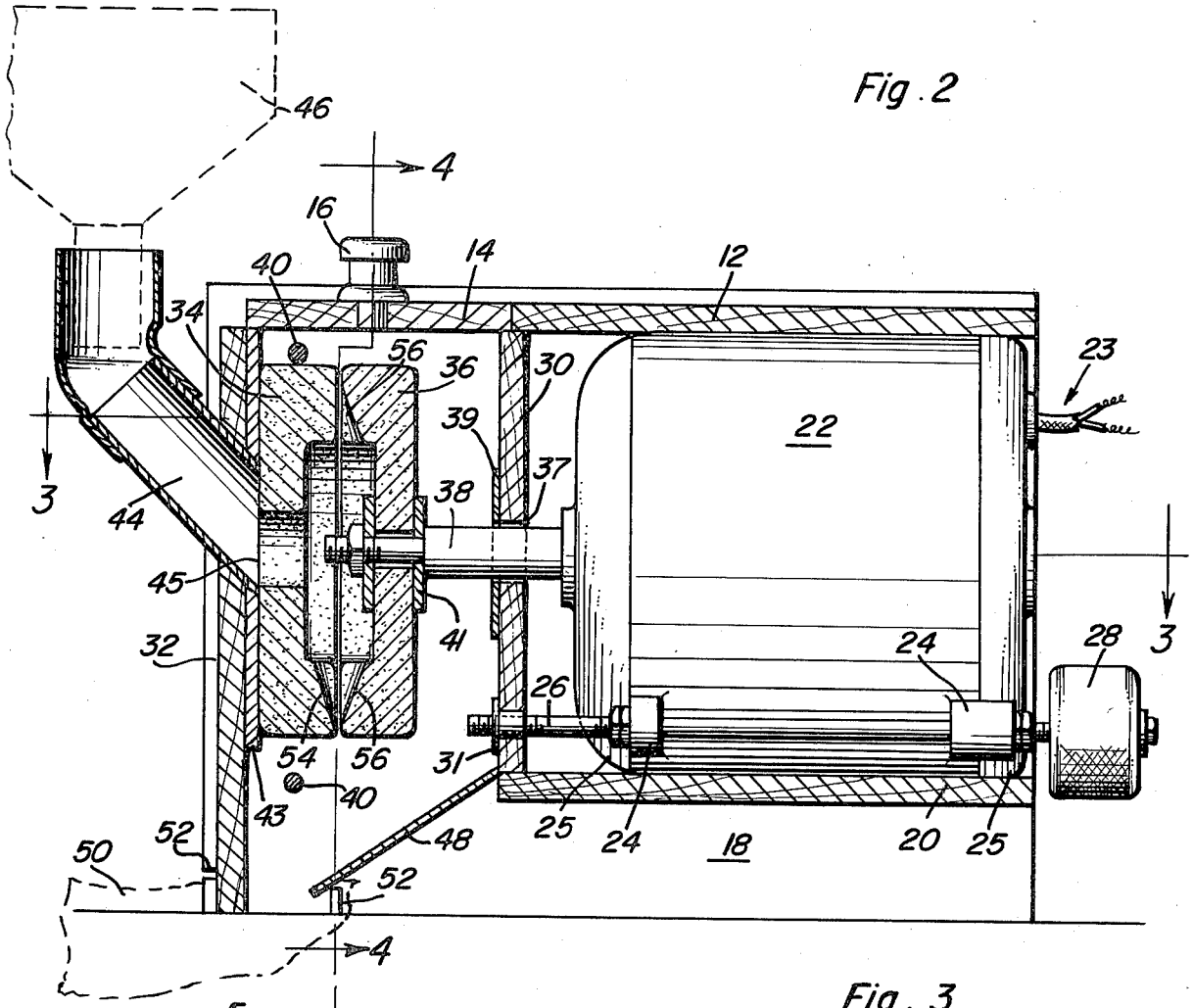
FIG. 2 is predominately cross-sectional, the view being taken approximately along the line 2—2 of FIG. 1.
Figure 3:
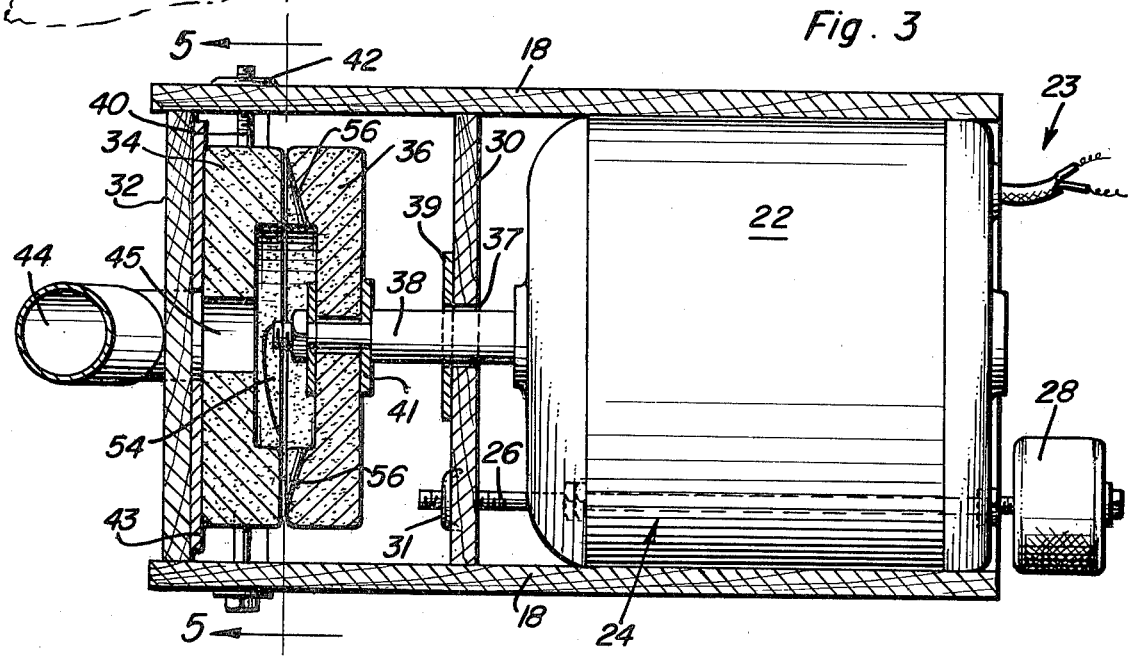
FIG. 3 is similarly cross-sectional, taken approximately along the line 3—3 of FIG. 2.

The non-rotating stone 34 further has a single, smoothly surfaced, notched-out portion 54, near the bottom of the stone (as viewed in FIGS. 2, 3 and 5). This cooperating to form a passageway for the grain to flow from the funnel-spout area 44–46 through aperture 45, portion 54, and on to the area between the stones 34 and 36. The rotating stone 36 has four smooth, notch-out portions 56, partly of hemi-truncated-cone-shape extending from the central portion of the stone and blending into a semi-cylindrical shape before reaching the periphery of the stone, which further assist in forming passageways which direct the grain to the outer areas of the facing surfaces of the stones, where the final grinding takes place before the flour is discharged beyond the peripheries of the stones.

A guide-board 48 extends from the lower portion of wall 30 downwardly toward the lowermost portion of the wall 32, but stopping short thereof, and extending between the walls 18. This board 48 cooperates with the top wall 14, walls 30 and 32, and the side walls 18, to form a hopper and passageways leading the flour to the bottom of the board 48, and into a bag 50, or similar receiving receptacle, held in place by the notches 52 in the side walls 18.

In the preferred embodiment, the over-all dimensions of the mill are approximately eight or nine inches in square cross-section, and approximately one foot in its longitudinal dimension, with a one inch metallic or plastic filler spout (plus a kitchen funnel or a plastic bottle with the bottom cut-off) extending beyond one end, and an approximately one inch thick and two inch diameter turning knob extending beyond the other end.

The preferred size of the grinding stones are approximately one inch thick and five inches in diameter. The various walls are preferably of wood and the guideboard of slick finished pressed wood, such as "Masonite", or similar products; however, any materials of sufficient strength, and where grain is contacted, sufficiently capable of being kept sanitary, would suffice.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A grain mill having one rotatable stone and one non-rotatable stone in facing relationship to each other, a grain feeding means associated with the non-rotatable stone to feed grain between the stones, collecting means for receiving ground material discharged from the peripheries of the stones, means for driving the rotatable stone, means for adjusting the spacing between said stones, said means for driving said rotatable stone and the means associated with said non-rotatable stone being surrounded by an outer housing including a top wall, vertical side walls, an exterior vertical end wall, a partial bottom wall under a motor for actuating the means for driving said rotatable stone, an interior wall parallel to said end wall and between said motor and said end wall, said means for adjusting the spacing between said stones including a sleeve portion on the periphery of said motor, a threaded rod passing through said interior wall and said sleeve and having a turning knob attached at one end thereof, whereby manual rotation of said threaded rod, via said knob, moves said motor and associated stone toward or away from said non-rotatable stone for adjusting the spacing between said stones.

2. A grain mill having one rotatable stone and one non-rotatable stone in facing relationship to each other, a grain feeding means associated with the non-rotatable stone to feed grain between the stones, collecting means for receiving ground material discharged from the peripheries of the stones, means for driving the rotatable stone, a motor for actuating said means for driving said rotatable stone, means for adjusting the spacing between said stones, said means for driving said rotatable stone being surrounded by an outer housing, said housing including a top wall, vertical side walls, an exterior vertical end wall, a partial bottom wall under said motor, an interior wall parallel to said end wall and between said motor and said end wall, said means for adjusting the spacing between said stones including a sleeve portion on the periphery of said motor, a threaded rod passing through said interior wall and said sleeve and having a turning knob attached at one end thereof, whereby manual rotation of said threaded rod, via said knob, moves said motor and associated stone toward or away from said non-rotatable stone for adjusting the spacing between said stones.

3. A grain mill comprising:

a rotatable stone and a non-rotatable stone disposed in facing relation;

means associated with the non-rotatable stone to feed grain between the stones;

means collecting ground material discharged peripherally of the stones;

drive means connected with said rotatable stone;

means for adjusting the spacing between said stones;

means adjustably supporting the non-rotating stone for positioning and maintaining the facing surfaces of said stones to be in parallel relation;

said drive means and stones being surrounded by an outer housing including a top wall, vertical side walls, an exterior end wall, a partial bottom wall under a motor for actuating the drive means, and an interior wall between the motor and the stones and parallel to the end wall, and said means for adjusting the spacing between the stones including a sleeve-like portion on the periphery of the motor, a turning knob attached to one end of a threaded rod passing through said sleeve-like portion, and said threaded rod further being threaded into a claw-nut in said interior wall, a pair of double lock nut assemblages, one adjacent each end of the sleeve-like portion and each mounted on the threaded rod, to move the motor and its associated drive means and movable stone toward and away from the non-rotatable stone to thereby adjust the spacing between the stones, upon rotation of said turning knob.

4. The mill of claim 3 wherein said outer housing further includes a fill spout supported in said vertical end wall, and having a central aperture leading to a central aperture in the non-rotatable stone which is permanently attached to said end wall, and retaining and tightening rods releasably engaging the vertical side walls of said outer housing to allow the end wall with its associated fill spout and stationary stone to be incrementally moved toward said rotating stone until there is contact between the two stones to insure parallelism with respect to the facing portions of the two stones.

5. The mill of claim 4, wherein said retaining and tightening rods are secured with said vertical side walls, after parallalism is obtained to rigidify the outer housing structure during operation of the mill.

6. The device of claim 5 wherein said non-rotatable stone has a single, smooth, notched-out portion to lead the incoming grain from the central aperture to an area adjacent the outer edge of said non-rotatable stone.

7. The mill of claim 6 wherein the cooperating rotatable stone has four smooth notched-out portions, each approximately 90° away from its next adjacent notched-out portion, to further guide the grain to the outer peripheral areas of the cooperating stones where the final grinding takes place before discharge of the grain.

8. The mill of claim 7 wherein said motor is an electric motor with appropriate wiring for connection with a source of electric power.

9. The mill of claim 8 wherein the lower portion of the outer housing adjacent the area where the grain is discharged from between the stones is provided with means to retain a bag, or similar receptacle, to receive the flour.

10. A grain mill having one rotatable stone and one non-rotatable stone in facing relationship to each other;

a grain facing means associated with the non-rotatable stone to feed grain between the stones;

collecting means for receiving ground material discharged from the peripheries of the stones;

means for driving the rotatable stone;

means for adjusting the space between said stones;

further means for positioning and maintaining the facing surfaces of the stones parallel to each other;

said means for driving said rotatable stone and the means associated with said non-rotatable stone being surrounded by an outer housing including a top wall, vertical side walls, an exterior vertical end wall, a partial bottom wall under a motor for actuating the means for driving said rotatable stone, an interior wall parallel to said end wall and between said motor and said end wall, said means for adjusting the spacing between said stones including a sleeve portion on the periphery of said motor, a turning knob attached to one end of a threaded rod passing through said sleeve portion, said threaded rod being further threaded into nut means mounted on said interior wall, further nut assemblies, one adjacent each end of the sleeve portion, similarly threaded onto said threaded rod whereby rotation of said threaded rod by turning of the knob will move said associated rotatable stone toward and away from said non-rotatable stone to adjust the spacing between said stones.

11. The mill of claim 10 wherein said interior wall nut means are claw-nut means, the claws of which penetrate said interior wall to fix the position of said nut means.

12. The mill of claim 10 wherein said further nut assemblies are a pair of double lock nut means, one associated with each end of said sleeve portion.

13. The mill of claim 10 wherein said facing stones each have facing notched-out portions to assist in guiding grain to the area between the stones.

* * * * *